US007225935B2

(12) United States Patent
Breymaier et al.

(10) Patent No.: US 7,225,935 B2
(45) Date of Patent: Jun. 5, 2007

(54) SUPPORT SYSTEM FOR RACK ELEMENTS

(75) Inventors: Werner Breymaier, Rottenacker (DE); Johann Karcher, Munderkingen (DE); Josef Kloker, Altheim (DE)

(73) Assignee: Element-System Rudolf-Bohnacker GmbH, Rottenacker (DE)

( * ) Notice: Subject to any disclaimer, the term of this patent is extended or adjusted under 35 U.S.C. 154(b) by 260 days.

(21) Appl. No.: 10/725,111

(22) Filed: Dec. 1, 2003

(65) Prior Publication Data

US 2004/0108288 A1 Jun. 10, 2004

(30) Foreign Application Priority Data

Nov. 30, 2002 (DE) ..... 202 18 574 U

(51) Int. Cl.
*A47F 5/08* (2006.01)

(52) U.S. Cl. ..... 211/94.01; 211/103; 248/225.11

(58) Field of Classification Search ..... 211/94.01, 211/94.02, 119.1, 70.1, 88.01, 100, 97, 116, 211/119.004, 150; 248/224.51, 224.61, 225.11, 248/225.2, 298.1, 214, 219.3, 219.1, 220.21
See application file for complete search history.

(56) References Cited

U.S. PATENT DOCUMENTS

| | | | | | |
|---|---|---|---|---|---|
| 974,953 | A * | 11/1910 | Darlinton | 16/269 |
| 1,406,303 | A * | 2/1922 | Tomkinson | 160/235 |
| 1,474,660 | A * | 11/1923 | White | 249/212 |
| 2,066,444 | A * | 1/1937 | Albert | 16/355 |
| 2,302,661 | A * | 11/1942 | Benson | 16/267 |
| 2,477,977 | A * | 8/1949 | Gelb | 211/106 |
| 2,549,110 | A * | 4/1951 | Michael | 244/129.4 |
| 2,606,734 | A * | 8/1952 | Magnuson | 248/215 |
| 2,799,890 | A * | 7/1957 | Stavich | 16/269 |
| 3,197,934 | A * | 8/1965 | Brown | 52/592.4 |
| 3,199,821 | A * | 8/1965 | Story | 248/242 |
| 3,321,167 | A * | 5/1967 | Doerr | 248/243 |
| 3,633,244 | A * | 1/1972 | Grossman | 16/355 |
| 3,863,372 | A * | 2/1975 | Stilling | 40/574 |
| 3,904,041 | A * | 9/1975 | Medgebow | 211/72 |
| 3,958,788 | A * | 5/1976 | Feibelman | 248/214 |
| 4,094,415 | A * | 6/1978 | Larson | 211/57.1 |
| 4,123,822 | A * | 11/1978 | Bentley | 16/355 |
| 4,388,961 | A * | 6/1983 | Schaefer et al. | 160/332 |
| 4,454,904 | A * | 6/1984 | Oxman | 160/332 |

(Continued)

FOREIGN PATENT DOCUMENTS

DE 83 28 175.4 U1 1/1984

(Continued)

*Primary Examiner*—Sarah Purol
*Assistant Examiner*—James C. Dooley
(74) *Attorney, Agent, or Firm*—Laurence A. Greenberg; Werner H. Stemer; Ralph E. Locher

(57) ABSTRACT

A support system for rack elements has a support element and a hanging element. The support element has an upwardly projecting suspension rail and the hanging element is provided with a slot, by which the hanging element can be plugged onto the suspension rail. The support system is distinguished in that the suspension rail is provided with a curvature, and the slot has a corresponding curvature, with the result that the hanging element can be plugged onto the suspension rail, and removed therefrom, by a rotary movement.

9 Claims, 3 Drawing Sheets

U.S. PATENT DOCUMENTS 4,461,443 A * 7/1984 Dauman ..... 248/220.41
4,582,001 A * 4/1986 Leikarts ..... 108/106
D286,495 S * 11/1986 Blomdahl ..... D8/373
4,678,152 A * 7/1987 Cheng ..... 248/225.11
4,785,946 A * 11/1988 Sorensen ..... 211/187
4,832,207 A * 5/1989 Alexander ..... 211/57.1
4,852,213 A * 8/1989 Shewchuk ..... 16/266
4,869,378 A * 9/1989 Miller ..... 211/94.01
4,979,712 A * 12/1990 Rios ..... 248/215
5,050,832 A * 9/1991 Lee et al. ..... 248/225.11
5,087,007 A * 2/1992 Gaderick ..... 248/215
5,110,080 A 5/1992 Rieman
D342,015 S * 12/1993 Andrejew ..... D8/373
5,351,929 A 10/1994 Vallance
5,413,297 A * 5/1995 Adams ..... 248/215
5,535,971 A * 7/1996 Adams ..... 248/215
5,553,823 A * 9/1996 Protz, Jr. ..... 248/304
5,607,131 A * 3/1997 Adams ..... 248/215
5,638,644 A * 6/1997 Bastian ..... 52/36.6
5,687,856 A * 11/1997 Kendrena ..... 211/70.6
5,772,054 A * 6/1998 Potter ..... 211/87.01
5,806,692 A * 9/1998 Pepper ..... 211/88.01
5,810,304 A * 9/1998 Lehrman ..... 248/215
5,815,886 A * 10/1998 Nishio et al. ..... 16/360
5,819,958 A * 10/1998 Dement ..... 211/90.01
5,848,698 A * 12/1998 Stompe ..... 206/449
5,950,337 A * 9/1999 Lehrman ..... 38/103
6,349,507 B1 * 2/2002 Muellerleile ..... 52/36.5
6,364,260 B1 * 4/2002 Lorincz et al. ..... 248/215
6,378,828 B1 * 4/2002 Valiulis et al. ..... 248/231.81
6,499,188 B1 * 12/2002 Cheng ..... 16/269
6,669,154 B1 * 12/2003 Remmers ..... 248/225.11
6,687,956 B1 * 2/2004 Foo ..... 16/269
D490,697 S * 6/2004 Runnalls ..... D8/380
6,772,905 B2 * 8/2004 Cheng ..... 220/840
6,854,610 B2 * 2/2005 Adams ..... 211/118
2004/0094679 A1 * 5/2004 Rose et al. ..... 248/220.21

FOREIGN PATENT DOCUMENTS

DE 43 28 483 A1 3/1994
DE 299 10 167 U1 10/1999
WO 89/07409 8/1989
WO 2004/000073 A1 12/2003

* cited by examiner

SUPPORT SYSTEM FOR RACK ELEMENTS

BACKGROUND OF THE INVENTION

Field of the Invention

The invention relates to a support system for rack elements having a support element and a hanging element. The support element has an upwardly projecting suspension rail and the hanging element has a slot by which the hanging element can be plugged on to the suspension rail.

A rack-support system of the generic type is known from U.S. Pat. No. 5,110,080 which provides a retaining strip that can be installed horizontally on a wall or a corresponding surface and in which hanging bars can be suspended vertically. Furthermore, horizontal supports for shelves of a rack can be fastened onto the hanging bars.

The retaining strip here has a bottom edge that is curved obliquely upward, in order for it to be possible for correspondingly shaped slots on the hanging bars to be plugged thereon. The retaining strip also has a top edge, which is bent obliquely downward and is configured such that a suspended hanging bar cannot be drawn off from the bottom edge. This configuration prevents the hanging bar from being detached in an undesirable manner from the retaining strip, for example as a result of an unintentional thrusting movement, and thus prevents the entire rack from possibly falling apart.

In order for the hanging bar to be plugged onto the bottom edge of the retaining strip and removed therefrom, the top edge is provided with additional cutouts. This form of retaining strip, however, is associated with increased production outlay. It is also disadvantageous that, during assembly of a rack, it is only possible for the hanging bar to be plugged onto the positions which are predetermined by the cutouts, and then to be pushed laterally, via the bottom edge, to a desired location. This renders assembly, in particular with a multiplicity of hanging bars, complicated and time-consuming. It is also the case that the operation of exchanging an individual hanging bar proves, in certain circumstances, to be a lengthy one if, in the first instance, adjacent hanging bars have to be displaced and, if appropriate, removed.

SUMMARY OF THE INVENTION

It is accordingly an object of the invention to provide a support system for rack elements which overcomes the above-mentioned disadvantages of the prior art devices of this general type, which is distinguished by a more straightforward configuration and more flexible handling.

With the foregoing and other objects in view there is provided, in accordance with the invention, a support system for rack elements. The support system contains a support element having an upwardly projecting suspension rail with a given curvature, and a hanging element having a slot formed therein and by the slot the hanging element can be plugged onto the suspension rail. The slot has a curvature corresponding to the given curvature, with which the hanging element can be plugged onto the suspension rail by a rotary movement.

According to the invention, the support system contains the support element with the upwardly projecting suspension rail and the hanging element that has a slot, by which the hanging element can be plugged onto the suspension rail. The suspension rail has a curvature, and the slot of the hanging element has a corresponding curvature, with the result that the hanging element can be plugged onto the suspension rail, and removed therefrom, by a rotary movement. The configuration secures the plugged-on hanging element against unintentional detachment from the suspension rail, for example as a result of a thrusting movement. It is also the case that the hanging element can be plugged onto the suspension rail of the support element at any desired location, thus providing for flexible handling. The support system is further distinguished by a straightforward construction.

In a preferred embodiment, the curvature of the suspension rail of the support element is configured in a radial direction. In contrast to configurations with a non-radial curvature, the slot of the hanging element in this embodiment may be provided with a small amount of play, with the result that high stability of the plugged-on hanging element is achieved.

It is further preferred that the curvature of the suspension rail of the support element covers a sector of a circle of at least 30°. This results in the plugged-on hanging element being secured in a reliable manner against accidental detachment.

In a further preferred embodiment, the support element is produced from a sheet-metal strip, the suspension rail being formed by upwardly directed bending of a bottom edge of the sheet-metal strip. A support element that is configured in this way can be produced straightforwardly and cost-effectively from a metal sheet by using corresponding punching and pressing machines.

According to a further preferred embodiment, the hanging element is provided with an oblique abutment surface, by which the hanging element can be positioned against the support element before being plugged onto the suspension rail. This simplifies the plug-on operation since the hanging element is placed in a predetermined position on the suspension rail. This also makes it possible to avoid any deformation of the suspension rail during the plug-on operation as a result of incorrect positioning of the slot relative to the suspension rail.

In accordance with an added feature of the invention, the hanging element has a U-shaped crossed section and is formed from two parallel side walls with a crosspiece located therebetween. The side walls each have the slot formed therein and the crosspiece has cutouts formed therein for accommodating the rack elements.

In accordance with a further feature of the invention, the support element has a substantially rectangular stamped portion disposed above the suspension rail. The stamped portion has cutouts formed therein for receiving screws, including countersunk head screws, for fastening the support element on a wall or on a corresponding surface.

In accordance with another feature of the invention, the support element has a substantially U-shaped cross-section formed from two parallel side walls with a crosspiece disposed therebetween. The suspension rail is formed on each bottom edge of one of the side walls.

Other features which are considered as characteristic for the invention are set forth in the appended claims.

Although the invention is illustrated and described herein as embodied in a support system for rack elements, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

BRIEF DESCRIPTION OF THE DRAWINGS

FIG. 5 is a perspective view of a further embodiment of the support element according to the invention with the hanging bar plugged on.

DESCRIPTION OF THE PREFERRED EMBODIMENTS

Figure 1:
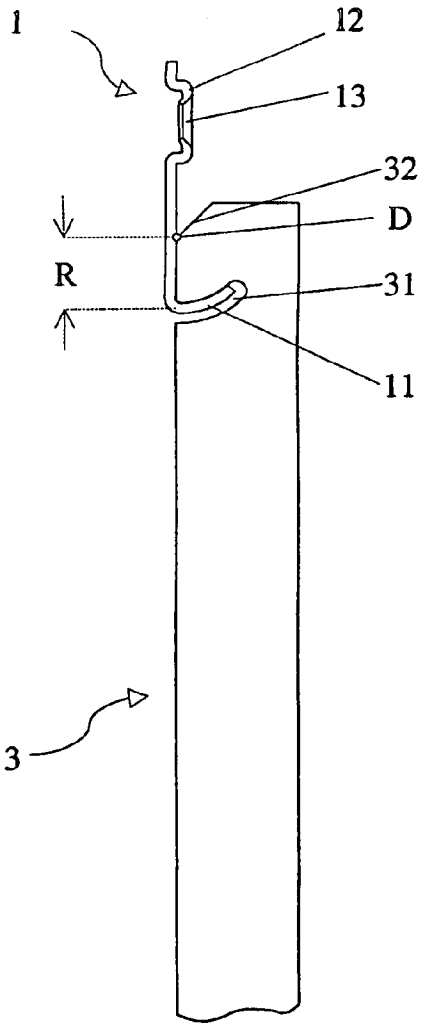
FIG. 1 is a diagrammatic, side-sectional view of a support system containing a support element and a hanging element configured as a hanging bar and has been plugged onto a suspension rail of the support element according to the invention.

Referring now to the figures of the drawing in detail and first, particularly, to FIG. 1 thereof, there is shown a side-sectional view of a support system according to the invention. The support systems contains a support element 1 and a hanging element 3 which has been plugged onto the support element 1 and, in the present embodiment, is configured as a vertical hanging bar 3. The support element 1 is produced cost-effectively from a sheet-metal strip and has a curved suspension rail 11, which is formed by a bottom edge of the sheet-metal strip being bent upward. The hanging bar 3 is provided with a correspondingly shaped slot 31, with the result that the hanging bar 3 can be plugged onto the suspension rail 11 of the support element 1, and removed therefrom, by a rotary movement. The hanging bar 3 is thus secured in relation to accidental detachment as a result of an upwardly directed thrusting movement.

The curvature of the suspension rail 11 of the support element 1 and of the slot 31 of the hanging bar are configured in a radial direction with a center point of a circle with a radius R predetermined by the curvature ending up located on the front side of the support element 1. At the same time, the axis of rotation D of the rotary movement, as the hanging bar 3 is plugged on or removed, runs through the center point. The axis of rotation D is thus oriented perpendicularly to the plane of the drawing in FIG. 1.

If a hanging element, like the hanging bar 3 shown in FIG. 1, has a top end section which projects beyond the axis of rotation D, then the end section has to be provided with an oblique portion in order for it to be possible for the hanging element 3 to be plugged on and removed by a rotary movement.

Figure 2:
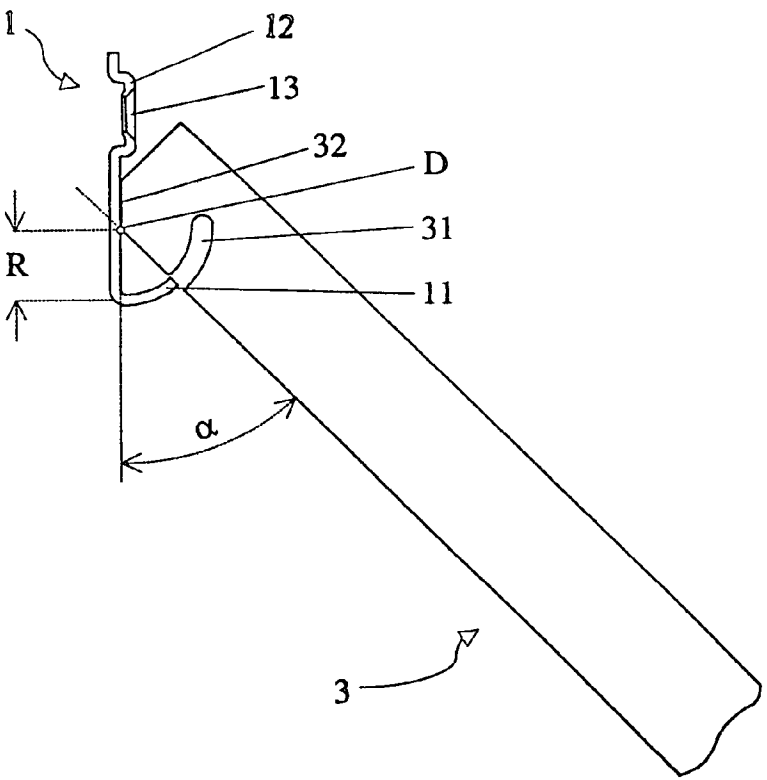
FIG. 2 is a side-sectional view of the support system according to the invention, the hanging car butting against the support element in a rotated position.

In the case of the hanging bar 3 shown, the oblique portion functions, at the same time, as an abutment surface 32, as can be seen in FIG. 2.

The support element 1 has, above the suspension rail 11, an essentially rectangular stamped portion 12, which is provided with cutouts 13 in which it is possible to dispose screws, in particular countersunk head screws, for fastening the support element 1 on a wall or a corresponding surface. The stamped portion 12 increases the buckling strength and torsional rigidity of the support element 1. Disposing the stamped portion 12 above the suspension rail 11 and the plugged-on hanging bar 3 allows straightforward installation or adjustment of the support element 1 and tightening of the screws even with the hanging bar 3 plugged on.

As FIG. 2 shows, the hanging bar 3, in a rotated position, butts against the support element 1 by way of the abutment surface 32. The plug-on operation is simplified as a result since the hanging bar 3 is automatically plugged onto the suspension rail 11 in the desired position.

In FIG. 2, the sector of a circle covered by the suspension rail 11 of the support element 1 is depicted by an angle of rotation $\alpha$. The angle $\alpha$ should be at least 30°, in order to make it possible for a plugged-on hanging element to be secured in a reliable manner against unintentional detachment. It is also the case, however, that the angle of rotation $\alpha$ should be no more than 45° in order to avoid the suspension rail 11 bending open as a result of excessive tensile forces when a hanging element is plugged on or removed. The maximum angle of rotation is preferably selected in dependence on the type of material and on the thickness of the material of the support element.

It is also conceivable to have configurations of the support system in which the suspension rail 11 of the support element 1 projects, in part, into the slot 31 of the hanging element 3 butting against the support element 1 by way of the abutment surface 32. This provides the hanging element 3 with additional securing, since an additional translatory movement is necessary in order to remove the hanging element 3 from the suspension rail 11.

Figure 3:
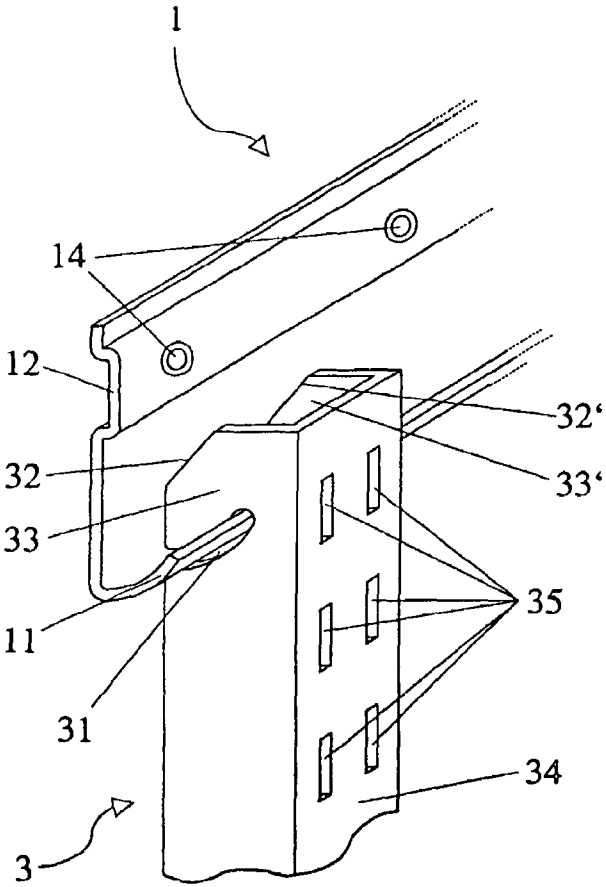
FIG. 3 is a perspective view of the support system according to the invention and corresponds to FIG. 1.

FIG. 3 shows a perspective illustration of the support system according to the invention that corresponds to FIG. 1. The support element 1 that is configured as a horizontal strip, is fastened on a wall by countersunk head screws 14. The use of countersunk head screws 14 gives the support element 1 a pleasing appearance.

The hanging bar 3 has a U-shaped cross section and is formed from two parallel side walls 33, 33' with a crosspiece 34 located therebetween. The side walls 33, 33' are each provided with the slot 31 and an abutment surface 32, 32'. It is only the slot 31 of the front side wall 33 which is illustrated in FIG. 3. The crosspiece 34 has cutouts 35 for accommodating correspondingly shaped hooks of horizontal bearing supports, the cutouts 35 in the case of the present hanging bar 3, being configured as a series of double perforations. Of course, a corresponding embodiment with a series of single perforations is also conceivable.

Figure 4:
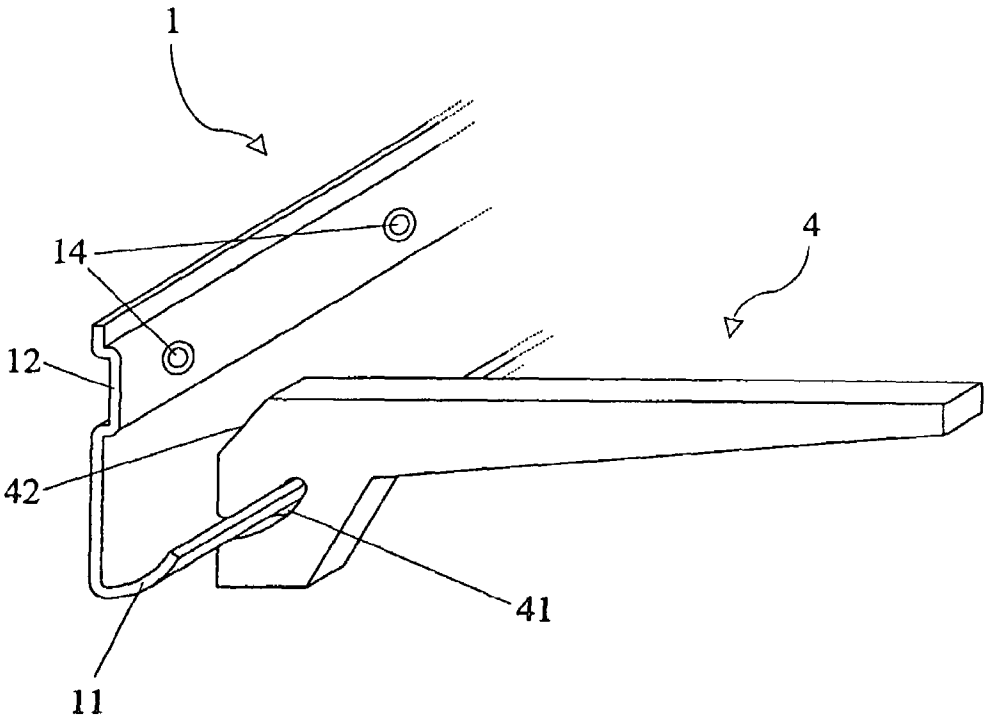
FIG. 4 is a perspective view of the support element according to the invention with a further embodiment of the hanging element, which is configured as a horizontal bearing support.

FIG. 4 shows a perspective illustration of the support element 1 according to the invention with a further embodiment of a plugged-on hanging element 4 configured as a horizontal bearing support 4 for a rack shelf. The bearing support 4 also has a radially curved slot 41 and an oblique abutment surface 42.

Figure 5:
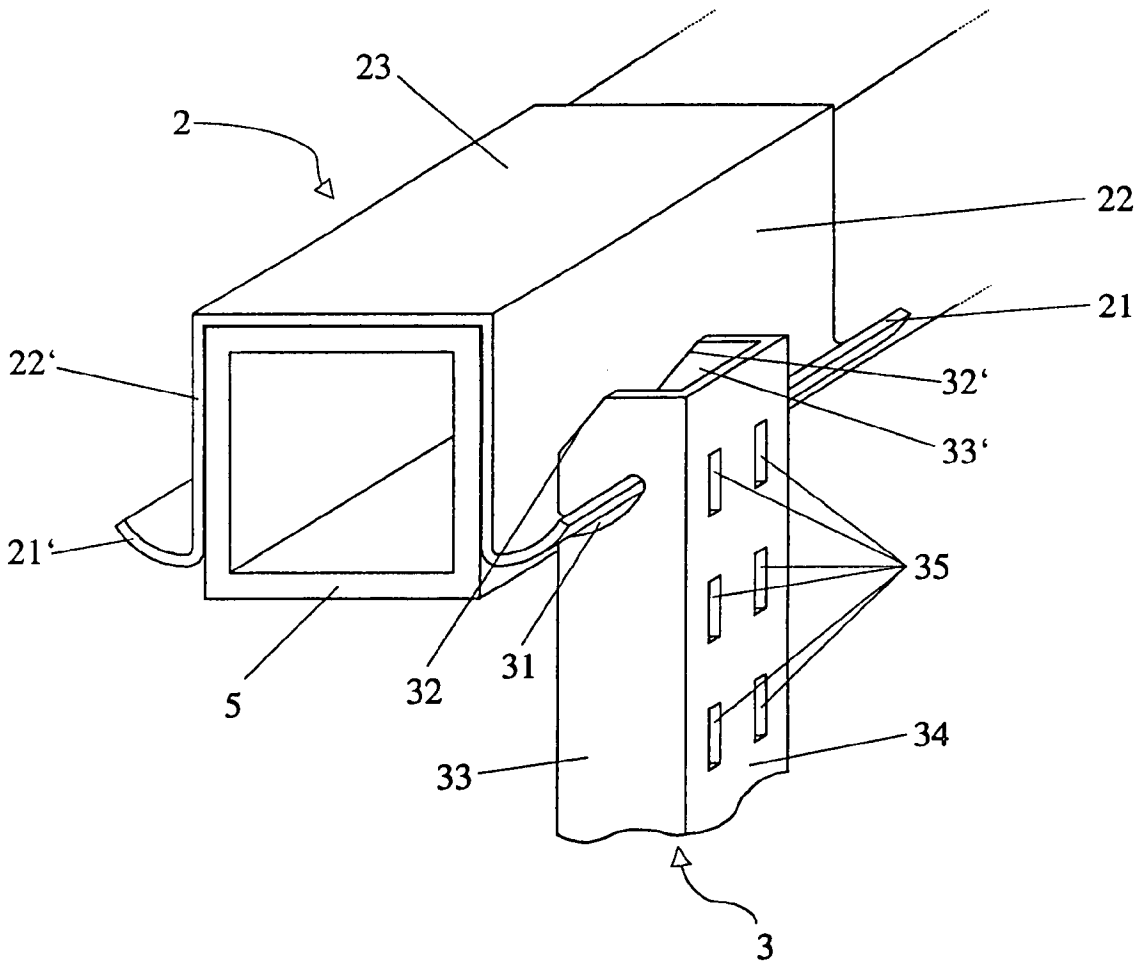

FIG. 5 shows a perspective illustration of a further embodiment of a support element 2 according to the invention with the hanging bar 3 plugged on. The support element 2 has an essentially U-shaped cross section and is formed from two parallel side walls 22, 22' with a crosspiece 23 located therebetween, a suspension rail 21, 21' being formed on each bottom edge of a side wall 22, 22'. The support element 2 can also be produced straightforwardly and cost-effectively from a sheet-metal strip.

In the case of the embodiment illustrated in FIG. 5, it is possible for hanging elements to be plugged on on both sides of the support element 2. The crosspiece 23 of the support element 2 functions as a bearing surface, by which the support element can be positioned on a supporting bar 5. In FIG. 5, the supporting bar 5 is a square tube. It is also conceivable, however, to have embodiments of the support element with a semicircular or round crosspiece, with the result that the support element can be positioned on a circular or round supporting bar.

We claim:

1. A support system for rack elements, the support system comprising:

a support element having an upwardly projecting suspension rail with a given curvature;

a hanging element having a slot formed therein, said slot plugging said hanging element onto said suspension rail, said slot having a curvature corresponding to said given curvature, with which said hanging element is plugged onto said suspension rail by a rotary movement, said curvature defining an axis of rotation, said hanging element having a top end portion projecting beyond said axis of rotation; and an oblique portion provided at said top end portion for allowing a rotary movement to place or remove said hanging element.

2. The support system according to claim 1, wherein said given curvature of said suspension rail is configured in a radial direction.

3. The support system according to claim 2, wherein said given curvature of said suspension rail covers a sector of a circle of at least 30°.

4. The support system according to claim 1, wherein said support element is formed from a sheet-metal strip and said suspension rail is produced from a bottom edge of said sheet-metal strip being bent upward.

5. The support system according to claim 1, wherein said hanging element has an oblique abutment surface, said oblique abutment surface positioning said hanging element against said support element before being plugged onto said suspension rail.

6. The support system according to claim 1, wherein said hanging element has a U-shaped crossed section and is formed from two parallel side walls with a crosspiece located therebetween, said side walls each having said slot formed therein and said crosspiece having cutouts formed therein for accommodating the rack elements.

7. The support system according to claim 1, wherein said support element has a substantially rectangular stamped portion disposed above said suspension rail, said stamped portion having cutouts formed therein for receiving screws, including countersunk head screws, for fastening said support element on a wall or on a corresponding surface.

8. The support system according to claim 1, wherein said support element has a substantially U-shaped cross-section formed from two parallel side walls with a crosspiece disposed therebetween, said suspension rail being formed on each bottom edge of one of said side walls.

9. A support system for rack elements, the support system comprising:

a support element having an upwardly projecting suspension rail with a given curvature; and a hanging element having a slot formed therein, said slot plugging said hanging element onto said suspension rail, said slot having a curvature corresponding to said given curvature, with which said hanging element is plugged onto said suspension rail by a rotary movement, said hanging element having a top end portion and an oblique abutment surface at said top end portion, said oblique abutment surface positioning said hanging element before said hanging element is plugged onto said suspension rail.

* * * * *